US008836450B2

(12) United States Patent
Päri et al.

(10) Patent No.: US 8,836,450 B2
(45) Date of Patent: Sep. 16, 2014

(54) ADJUSTABLE RESONATOR FILTER

(75) Inventors: Petri Päri, Kempele (FI); Jukka Puoskari, Tupos (FI)

(73) Assignee: Power Wave Technologies S.a.r.L., Luxembourg (LU)

( * ) Notice: Subject to any disclaimer, the term of this patent is extended or adjusted under 35 U.S.C. 154(b) by 370 days.

(21) Appl. No.: 13/293,817

(22) Filed: Nov. 10, 2011

(65) Prior Publication Data

US 2012/0119850 A1 May 17, 2012

(30) Foreign Application Priority Data

Nov. 12, 2010 (FI) ..... 20106188

(51) Int. Cl.
*H01P 1/202* (2006.01)
*H01P 1/205* (2006.01)
*H01P 1/208* (2006.01)

(52) U.S. Cl.
CPC ..... *H01P 1/2053* (2013.01); *H01P 1/2084* (2013.01)
USPC ..... 333/203; 333/206; 333/207

(58) Field of Classification Search
CPC .. H01P 1/2053; H01P 1/20309; H01P 1/2084
USPC ..... 333/202, 203, 206, 207
See application file for complete search history.

(56) References Cited

U.S. PATENT DOCUMENTS

| | | | |
|---|---|---|---|
| 2,749,523 | A | 6/1956 | Dishal |
| 3,792,385 | A | 2/1974 | Napoli et al. |
| 5,220,300 | A | 6/1993 | Snyder |
| 5,805,033 | A | 9/1998 | Liang et al. |

FOREIGN PATENT DOCUMENTS

| | | | |
|---|---|---|---|
| EP | 0759645 | A2 | 2/1997 |
| FI | 104298 | B | 12/1999 |
| FI | 106584 | B | 2/2001 |
| JP | 2004007056 | A | 1/2004 |
| JP | 2008182303 | A | 8/2008 |
| JP | 2008205692 | A | 9/2008 |

OTHER PUBLICATIONS

Finland Search Report for application No. 20106188 dated Oct. 12, 2011, 2 pages.

European Search Report dated Feb. 24, 2012 from European Application No. 11187667.8.

*Primary Examiner* — Robert Pascal
*Assistant Examiner* — Kimberly Glenn
(74) *Attorney, Agent, or Firm* — Caseiro Burke, LLC; Chris A. Caseiro

(57) ABSTRACT

An adjustable resonator filter comprised of cavity resonators. There is a movable conductive tuning element in the filter for adjusting each electromagnetic coupling, which element is located outside the resonator cavities. When the coupling between two resonators is the case, the movement of the tuning element changes the coupling between the signal ground and a fixed coupling element which extends from a resonator cavity to the next cavity, whereupon the strength of the coupling between the resonators changes. When the coupling between a resonator and the input/output line of the filter is the case, by means of the tuning element it is implemented a section with a low impedance inside a range with a relatively high impedance on the transmission path. This section moves together with the tuning element, in which case the strength of the coupling between the resonator and the line changes.

11 Claims, 6 Drawing Sheets

ADJUSTABLE RESONATOR FILTER

BACKGROUND OF THE INVENTION

The invention relates to a filter comprised of cavity resonators, the bandwidth of which filter can be adjusted. A typical application of the invention is an antenna filter in a base station of a cellular network.

In order that the frequency response of a bandpass filter would comply with the requirements, its passband must on the one hand be located at the right place on the frequency axis and on the other hand have the right width. In a resonator filter this requires that on the one hand the natural frequency of each resonator is right and on the other hand the strength of the couplings between the resonators are right. The coupling strength must be right also in the input and output of the filter, i.e. from the input line of the filter to its first resonator and from the last resonator of the filter to its output line.

In most filters both the place and width of the passband are intended to be fixed. However, the manufacturing process of a filter comprised of cavity resonators is in practice not so precise that its response would always comply with the specifications on grounds of only the mechanical dimensions. For this reason it has to be possible to tune also those filters. In some filters the width of the passband is intended to be fixed but the place of the passband must be selectable inside a certain total range. In this case, in addition to the basic tuning, an adjusting possibility is needed for shifting the passband.

The present invention relates to resonator filters, in which the width of the passband is selectable during the use. The width of the passband is adjusted by changing the coupling strength between the resonators and in the input and output of the filter. The adjusting of the bandwidth is based on the fact that so-called close coupling is arranged between successive resonators with the same natural frequency, in which case they have a double resonance. When the coupling is still strengthened in this situation, the resonance peaks of the double resonance move away from each other, which naturally affects so that the band widens. In the manufacturing stage the passband filter is in principle dimensioned so that the coupling strength between the middle resonators is the lowest, and the coupling strength between the resonators increases from the middle towards the ends of the filter. When all couplings are strengthened evenly, the filter's band widens and the fluctuation of the attenuation keeps low in the passband.

The adjustment of the strength of a coupling, or more briefly the 'coupling adjustment', can be implemented in many ways. One way is to provide the structure with metallic tuning screws so that these extend through the lid of the filter to the coupling openings between the resonators. When turning such a screw for example deeper into a coupling opening, the coupling strength between the resonators in question weakens, which has the effect of narrowing the band. Similar screws has been conventionally used for tuning the natural frequency of the coaxial resonators, in which case the screw extends through the filter lid into the resonator cavity at the inner conductor. A flaw of applying the tuning screws is that the junction between them and the surrounding metal can cause harmful passive intermodulation when the filter is in use. In addition, the electric contact in the threads can degrade in the course of time, which results in change in the tuning and increase in the losses of a resonator.

The coupling between two resonators can be adjusted also by means of a bendable tuning element arranged close to the coupling opening. The flaw of such solution is that in a multiresonator filter the tuning elements possibly have to be bent in several steps in order to achieve the desired frequency response. The filter lid has to be opened and closed for each time of adjustment, for which reason the tuning is time-consuming and relatively expensive.

FIGS. 1*a* and *b* present a way to adjust the coupling between the resonators of a filter, known from the publication U.S. Pat. No. 5,805,033. The filter comprises a conductive housing formed by a bottom 101, outer walls 104, and a lid 105, the space of which housing is divided into resonator cavities by conductive partition walls 112*a-b*. Two resonators 110, 120 of the filter are seen in FIG. 1*a* from above with the lid removed, and FIG. 1*b* shows the cross section of the filter at the partition wall of the resonators in question.

In the middle of each resonator cavity there is a cylindrical dielectric object for decreasing the size of the resonator, such as the dielectric object 111 of the first resonator 110 and the dielectric object 121 of the second resonator 120. The bases of the cylinder are parallel to the bottom 101 and lid 105 of the filter. The dielectric objects have been dimensioned so that a $TE_{01}$ waveform (Transverse Electric wave) is excited in them at the use frequencies of the filter. Thus the resonators are half-wave cavity resonators by type.

To implement the coupling between the resonators 110 and 120 there is an opening in their partition wall 112*a-b*, which opening extends from the lid to bottom and narrows towards the bottom. To adjust the coupling there is a tuning element 115 in the coupling opening, which is a round metallic plate parallel to the lid 105. The plate has been fastened to the lid through a threading rod which extends outside the filter housing. When the threading rod is turned, the tuning element 115 moves vertically and changes the coupling strength between the resonators. In the figure, the adjusting range of the tuning element is between the lower surface of the lid 105 and the plane represented by the upper part of the dielectric objects 111, 121. In this case, when the tuning element is insulated from the threading rod, the coupling becomes stronger when it is moved downwards, and vice versa. When the coupling strengthens, the resonance peaks of the resonator pair move away from each other, in which case the bandwidth increases.

A drawback of the solution described before is that the tuning of the bandwidth has been designed to be manual. In addition, the solution lacks the coupling adjustment in the input and output of the filter, which is necessary when the bandwidth needs to be able to be changed in a relatively wide range.

SUMMARY OF THE INVENTION

An object of the invention is to implement a new way to adjust the bandwidth of a resonator filter, which reduces the disadvantages related to the prior art. The resonator filter according to advantageous embodiments of the invention is disclosed in the following detailed description.

One aspect of the invention is the following: There is a movable conductive tuning element in a resonator filter for adjusting each electromagnetic coupling, which element is located outside the resonator cavities. When the coupling between two resonators is the case, the movement of the tuning element changes the coupling between the signal ground and a fixed coupling element which extends from a resonator cavity to the next cavity, in which case the strength of the coupling between the resonators changes. When the coupling between a resonator and the input/output line of the filter is the case, a section with a low impedance is implemented inside a range with a relatively high impedance on the transmission path of the filter by means of the tuning element.

This section moves together with the tuning element, which causes a change in the coupling between the resonator and the line.

An advantage of the invention is that the structure according to it enables a relatively wide adjusting range for the filter's bandwidth. In addition, the adjustment of the bandwidth can be made linear. Another advantage of the invention is that the effect of the adjustment of the bandwidth on the natural frequency of the resonators is minor, which facilitates the implementation of the adjustment. This is due to the above-mentioned fact that the movable tuning elements are located outside the resonator cavities. A further advantage of the invention is that the rise of the passive intermodulation is avoided in the adjusting mechanism of the filter according to the invention because the metallic junctions lack. A further advantage of the invention is that the adjustment of a filter can be automated, in other words be done without laborious manual work.

BRIEF DESCRIPTION OF THE DRAWINGS

In the following, the invention will be described in more detail. Reference will be made to the accompanying drawings, in which FIGS. 1*a,b* present an example of the prior art way to adjust the strength of the coupling between the filter's resonators.

DETAILED DESCRIPTION

Figure 1A:
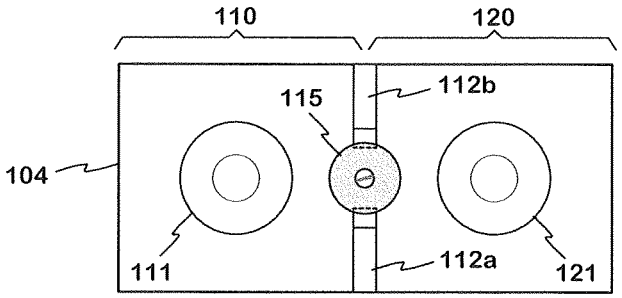
Fig. 1a PRIOR ART
Figure 1B:
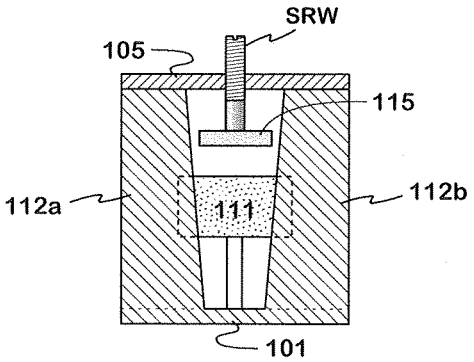
Fig. 1b PRIOR ART

FIGS. 1*a* and 1*b* were already explained in connection with the description of the prior art.

Figure 2A:
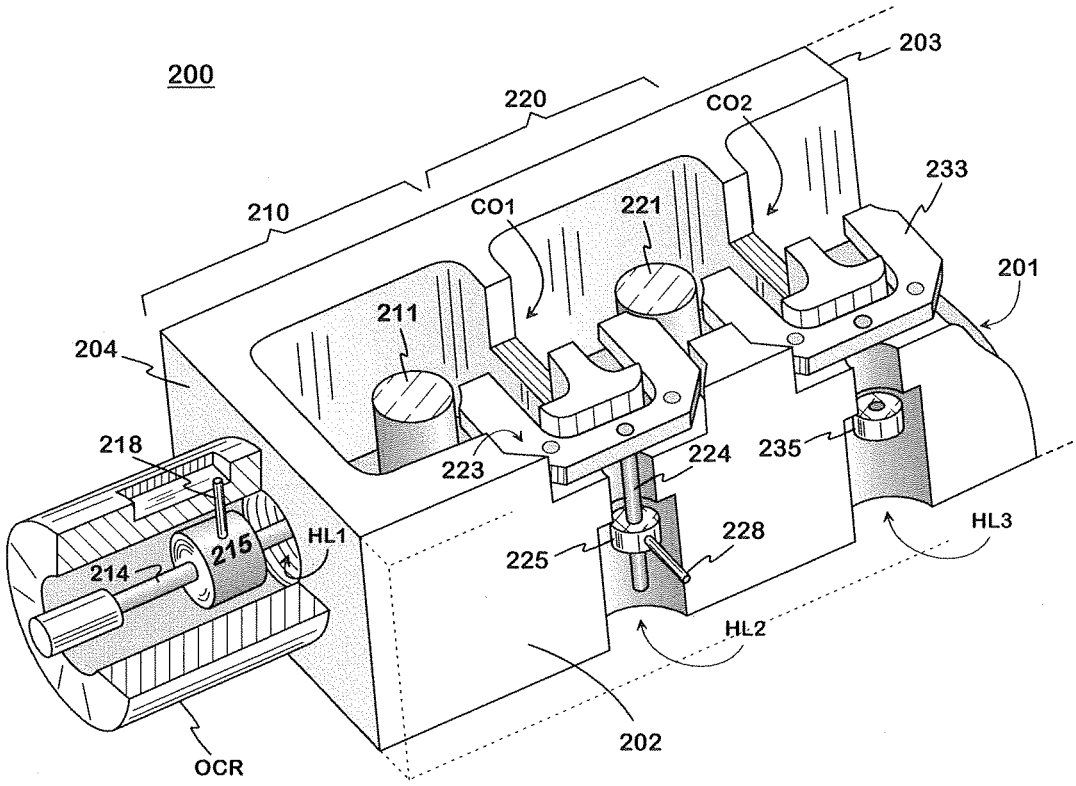
FIGS. 2*a-c* present an example of the adjustable resonator filter according to the invention.
Figure 2B:
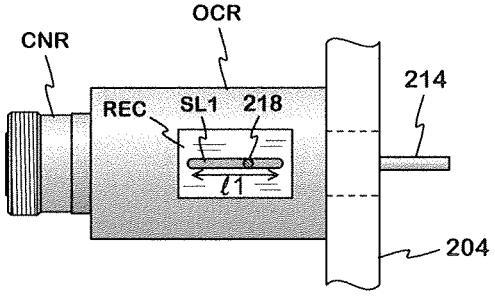
Figure 2C:
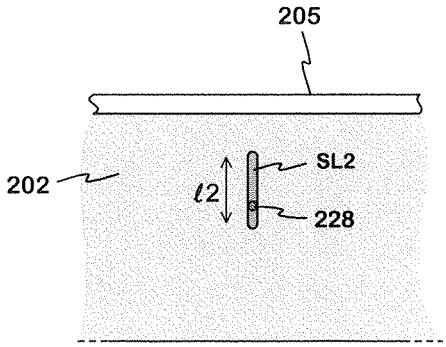

FIGS. 2*a-c* present an example of the adjustable resonator filter according to the invention. FIG. 2*a* shows the filter 200 as a perspective drawing. The filter comprises a conductive housing formed by a bottom 201, side walls 202, 203, head walls, 204 and a lid 205. In FIG. 2*a* the lid has been removed for graphicness and the whole filter has been truncated so that only its two successive resonators 210, 220 and partly a third resonator are visible. In addition, the first side wall 202 has been cut open so that the adjusting parts inside it are visible.

The space of the housing is divided into resonator cavities by conductive partition walls. In each resonator cavity there is the inner conductor 211; 221 of the resonator, which joins at its lower end galvanically the bottom 201, and the upper end of which conductor is in the air. Thus the resonators are in this example quarter wave resonators of coaxial type. Here, the quarter wave refers to the fact that the wavelength, which corresponds to the natural frequency of the resonator, is four times the electric length of the resonator. The outer conductor of a coaxial resonator is comprised of the housing walls and partition walls surrounding the inner conductor. In each partition wall separating two successive cavities there is a coupling opening CO1; CO2 to excite oscillation in the subsequent resonator on the transmission path. When the filter is in use, its housing is a part of the signal ground of the transmission path, or more briefly the ground.

In the example of FIG. 2*a* the first resonator 210 of said two resonators is the input resonator to which the filter's input line is connected. To adjust the coupling between the input line of the filter and the input resonator 210 the filter structure comprises a coaxial transmission line between the input line and input resonator, which comprises an outer conductor OCR and a middle conductor which is constituted by a conductor rod 214 and the conductive first tuning element 215. This conductor rod 214 is called 'middle rod' in order to make a distinction to the conductor rod in the adjusting mechanism of the coupling between the resonators. The outer conductor OCR, which is for graphicness cut open in FIG. 2*a*, connects galvanically to the head wall 204 of the filter housing. The middle rod 214 continues from the cavity formed by the outer conductor through an opening HL1 in the head wall to the cavity of the first resonator, in which it connects galvanically to the fixed coupling element 213 seen in FIG. 3.

The middle rod 214 goes through the cylindrical first tuning element 215. The conductor of the tuning element 215 is insulated from the middle rod by a dielectric layer which is so thin that the tuning element is functionally short-circuited to the middle rod at the use frequencies of the filter. The dielectric layer is either coating of the middle rod or the surface of the hole in the tuning element. Thus the first tuning element is supported as insulated to the middle rod. The friction between the tuning element 215 and the middle rod is so slight that the tuning element can be slid along the rod by a relatively low force. The movement of the first tuning element is implemented by means of a dielectric first control pin 218 attached to it. The first tuning element 215 is functionally a part of the middle conductor of said transmission line. At the tuning element the capacitance between the middle conductor and outer conductor is naturally higher and correspondingly the line's impedance lower than elsewhere. This matter will be explained more accurately in the description of FIG. 3.

There is a similar adjusting arrangement to the one described before for the adjustment of the coupling between the output resonator and output line of the filter.

To adjust the coupling between the first 210 and second 220 resonator the filter structure comprises a conductive coupling element 223, conductor rod 224 and conductive second tuning element 225. The coupling element 223 is fixed and extends from the cavity of the first resonator to the cavity of the second resonator through a canal in the upper part of the first side wall 202. The coupling element has been supported above the lower surface of the canal so that it is insulated from said side wall and the whole filter housing. The conductor rod 224 is mostly located in a vertical hole HL2 which extends through the bottom 201 and first side wall of the filter housing and opens to said canal. The conductor rod is fastened at its upper end galvanically to the coupling element 223.

The conductor rod 224 goes through the second tuning element 225 which also is then in said hole HL2. The second tuning element is conductive and in this example cylindrical. Its conductor is insulated from the conductor rod by a dielectric layer which is so thin that the tuning element is functionally short-circuited to the conductor rod at the use frequencies of the filter. The dielectric layer is either coating of the conductor rod 224 or the surface of the hole in the second tuning element 225. Thus the second tuning element is supported as insulated to the conductor rod. The friction between the second tuning element and the conductor rod 224 is so slight that the tuning element 225 can be slid vertically along the rod by a relatively low force. The movement of the second tuning element is implemented by means of a dielectric second control pin 228 attached to it, which is here horizontal.

The upper part of the hole HL2 is more confined than the lower part. When the second tuning element 225 is wholly in the upper part of the hole, there is only a narrow air gap between it and the inner surface of the hole. In this case a significant capacitive coupling exists from the coupling element 223 through the conductor rod and tuning element to the filter housing, or ground. When the second tuning element is wholly in the roomier lower part of the hole HL2, the capacitance between it and the side wall is negligible, and correspondingly the coupling from the coupling element to the ground is so weak that it is insignificant.

In each intermediate place of two successive resonators there is similar adjusting arrangement to the one described before.

FIG. 2*b* shows from the outside a transmission line for adjusting the input coupling, according to FIG. 2*a*. The transmission line is located between the coaxial connector CNR of the input cable and the wall 204 of the filter housing. There is a recess REC in the relatively thick outer conductor OCR of the transmission line for the mounting of an actuator which implements the adjustment of the coupling. A slot SL1, which has the same direction as the transmission line, opens from the bottom of the recess to the cavity of the transmission line. The above-mentioned first control pin 218 extends through this slot to the recess REC. The width of the slot SL1 equals the diameter of the cross-section of the control pin, and the first tuning element can be moved by the pin along the middle rod 214 inside the adjusting range l1 corresponding to the length of the slot.

FIG. 2*c* shows from the side the filter according to FIG. 2*a*, at the adjusting mechanism of the coupling between the first and second resonator. A part of the first side wall 202 and lid 205 of the filter housing is visible in the drawing. A vertical slot SL2 opens from the side wall to the hole HL2, in which the conductor rod 224 and the second tuning element 225 are located. Said second control pin 228 extends through this slot outside the filter housing. The width of the vertical slot SL2 equals the diameter of the cross-section of the second control pin, and the second tuning element can be moved by the pin along the conductor rod 224 inside the adjusting range l2 corresponding to the length of the slot.

Figure 3:
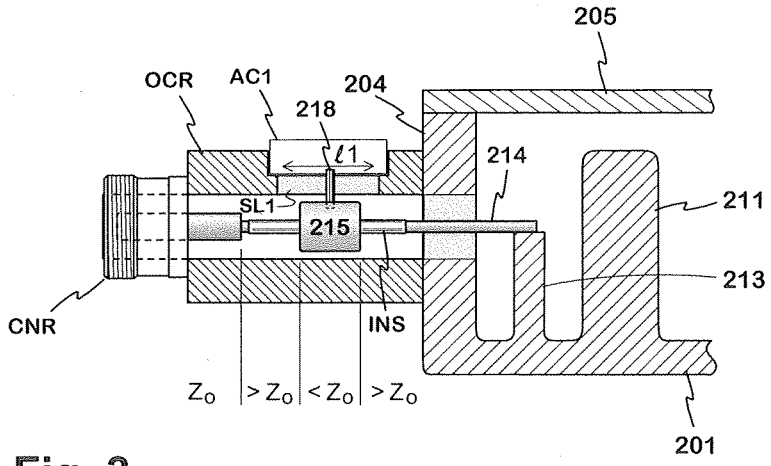
FIG. 3 presents as a longitudinal section the adjusting arrangement of the input coupling in the filter according to FIG. 2*a,*

FIG. 3 shows as a longitudinal section the adjusting arrangement of the input coupling in the filter according to FIG. 2*a*. The transmission line for the adjustment is a part of the transmission path of the filter so that its outer conductor OCR connects at its one end to the outer conductor of the filter's input connector CNR and at its other end to the head wall 204 of the filter housing, and the middle conductor of the transmission line connects at its one end to the middle conductor of the connector CNR and at its other end to a usual fixed coupling element 213 in the input resonator. This coupling element is a vertical conductor, which joins at its lower end the filter's bottom 201 near to the inner conductor 211 of the input resonator. The middle conductor of the transmission line is comprised of a part of the middle conductor of the connector CNR, said middle rod 214 and the cylindrical first tuning element 215. In the example of FIG. 3 the tuning element has been insulated from the middle rod by a dielectric coating INS of this rod. Also a first actuator AC1, with which the tuning element is moved by means of the control pin 218 coming through the slot SL1, is seen in FIG. 3, the actuator being located in the recess of the outer conductor OCR.

When starting from the connector, the impedance of the transmission line is first the nominal impedance $Z_O$ of the transmission path, which is for example 50Ω. In the portion of the transmission line between the first end of the middle rod 214 and the tuning element 215 its impedance is clearly higher than $Z_O$, because the middle rod is clearly thinner than the middle conductor of the connector. At the tuning element 215 the impedance of the transmission line is clearly lower than $Z_O$, because this tuning element is clearly thicker than the middle conductor of the connector. Onward from the tuning element towards the input resonator the impedance of the transmission line is again the same as before the tuning element. Thus the transmission line has a portion with a relatively low impedance between two portions with a relatively high impedance. When the tuning element 215 is moved towards the input resonator, the low-impedance portion moves with it, in which case the coupling between the resonator and input line becomes stronger, and vice versa. The width of the adjusting range of the coupling strength depends on the adjusting range l1 of the tuning element and on the fact at which distance from the head wall 204 this range begins. Also the diameter of the tuning element affects the matter very much: the narrower the air gap between the tuning element and the inner surface of the outer conductor OCR, the wider the adjusting range of the coupling strength.

Figure 4A:
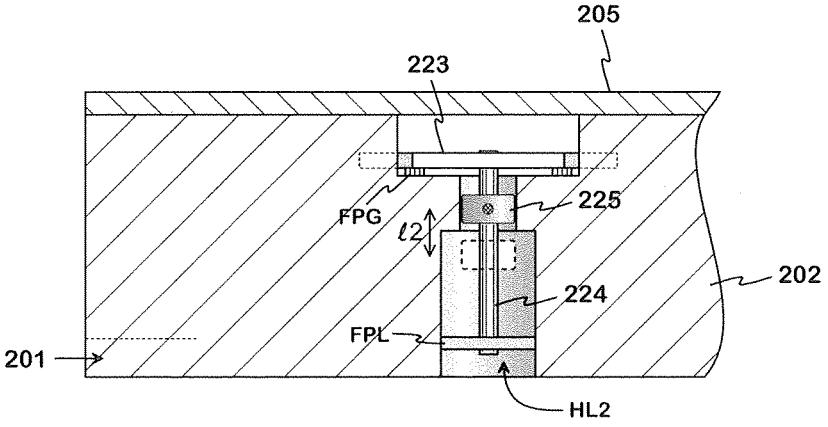
FIGS. 4*a,b* present the adjusting arrangement of the coupling between the resonators in the filter according to FIG. 2*a,*

FIG. 4*a* shows from the side the adjusting arrangement of the coupling between the first and second resonator in the filter according to FIG. 2*a*. The first side wall 202, bottom 201 and lid 205 of the filter have been cut so that the adjusting parts are visible. The fixed coupling element 223 is fastened by two dielectric pegs FPG to the lower surface of the canal in the first side wall, above that surface. The conductor rod 224, which is at its upper end fastened to the coupling element 223, is at its lower end supported by a dielectric plate FPL to the walls of the hole HL2 in the first side wall.

The total coupling between the resonators is comprised of the coupling through the coupling opening CO1 seen in FIG. 2*a* and the coupling through the coupling element 223. In the figure the second tuning element 225 is wholly in the upper part of the hole HL2, in which case only a narrow air gap surrounds the tuning element. The capacitance over this air gap is so high that the absolute value of the impedance between the tuning element and the side wall 202 at the use frequencies of the filter is for example 5Ω, which means that the fixed coupling element 223 is connected from its middle to the filter housing, or ground, through the conductor rod and tuning element. For this reason the effect of the coupling element on the total coupling between the resonators is minor. In this case the total coupling is at its maximum being based almost wholly on the coupling through the coupling opening CO1.

In FIG. 4*a* is drawn by a dashed line a situation, in which the second tuning element 225 is wholly in the lower part of the hole HL2, in which case the coupling from the coupling element 223 to the ground is so weak that it is insignificant. The coupling opening is dimensioned and the coupling element is positioned so that in this situation the coupling between the resonators implemented by the coupling element partly compensates the coupling, which takes place through the coupling opening, in which case the total coupling is at its minimum. When the tuning element is moved from the upper part of the hole HL2 to the lower part, the coupling between the resonators decreases, or weakens, quite linearly in the transition period when the tuning element is partly in the upper part of the hole and partly in the lower part. A practical adjusting range l2 of the tuning element has been marked in the figure.

Figure 4B:
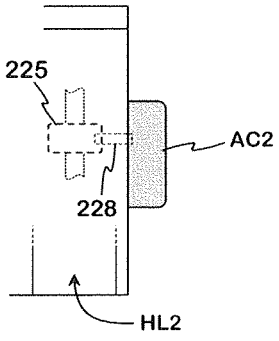

FIG. 4*b* shows the adjusting arrangement according to FIG. 4*a* seen from the head of the filter. A second actuator AC2 has been fastened to the first side wall 202 at the adjusting range of the second tuning element 225. The second control pin 228 attached to the second tuning element extends horizontally to the second actuator, which implements the movement of the second tuning element.

A weakening of the couplings inside the filter has a decreasing effect on the bandwidth of the filter as long as the coupling strength holds above the critical limit, and vice versa. Therefore, when all tuning elements 225, 235 in between the resonators are moved alike e.g. upwards from the lower part of the holes to the upper part, and at the same time the tuning elements 215 in the input and output of the filter are moved towards the resonators, the bandwidth of the filter increases linearly during the transition period.

Figure 5:
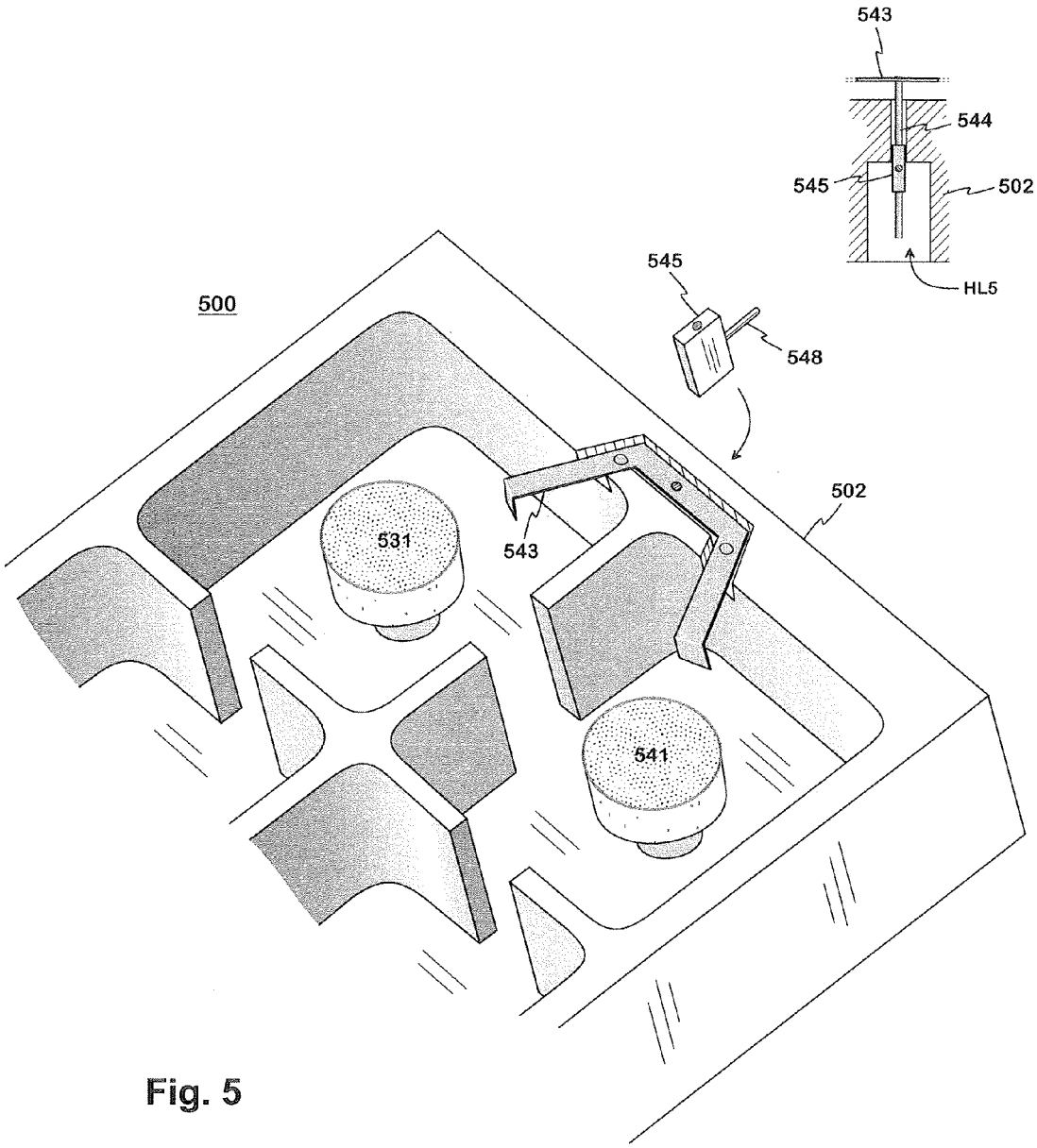
FIG. 5 presents a second example of the adjustable resonator filter according to the invention.

FIG. 5 shows a second example of the adjustable resonator filter according to the invention. The filter 500 comprises a conductive housing formed by a bottom, walls 502, and a lid. The space of the housing is divided into resonator cavities by conductive partition walls, and in each partition wall separating two successive resonators there is a coupling opening. In the drawing the lid has been removed and the filter has been cut so that only the cavities of two resonators are wholly visible. In each resonator cavity there is a cylindrical dielectric resonator object for making the resonator smaller, such as the dielectric resonator objects 531 and 541 seen in the drawing. The bases of the cylinder are parallel to the bottom and lid of the filter and it is supported at a certain height from the filter's bottom by a dielectric support leg. The dielectric resonator objects have been dimensioned so that a $TE_{01}$ waveform is excited in them at the use frequencies of the filter. Thus the resonators are half-wave cavity resonators by type.

For the adjustment of the coupling between successive resonators the filter structure comprises a fixed coupling element 543 extending from one resonator cavity to the next, conductor rod 544 and conductive tuning element 545 supported thereto, as in FIG. 2*a*. The conductor rod is fastened at its upper end to the coupling element 543 and is mostly located in a vertical hole HL5, which extends through the bottom and a wall of the housing and has an upper part and a roomier lower part, as in FIG. 2*a*. Further, the tuning element can be slid along the conductor rod by means of a control pin 548 fastened to it so that the coupling element's 543 coupling to the ground changes clearly, as in the previous example. The difference compared with the adjusting arrangement shown in FIGS. 2*a* and 4 is that now the tuning element 545 is quite a flat rectangular prism, and correspondingly the surfaces of the upper part of the hole HL5 are planar.

Figure 6:
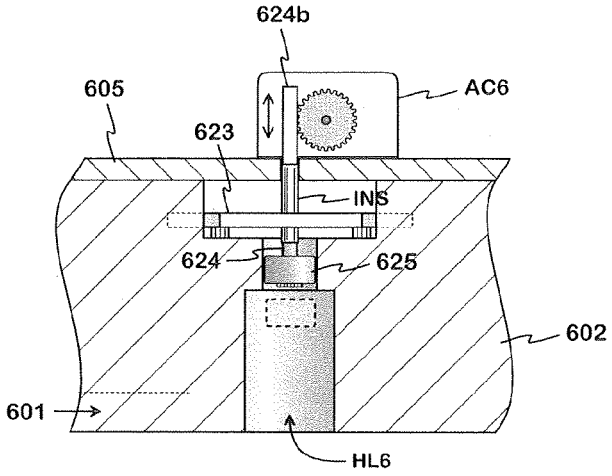
FIG. 6 presents a third example of the adjusting arrangement of the coupling between the resonators in the filter according to the invention.

FIG. 6 shows a third example of the resonator filter according to the invention in respect of the adjusting arrangement of the coupling between the resonators. The drawing presents the adjusting arrangement from the side, the side wall 602, bottom 601, and lid 605 of the filter cut as in FIG. 4*a*. The arrangement comprises a fixed coupling element 623, a movable tuning element 625 in a two-part vertical hole HL6 and a conductor rod 624, as in FIG. 4*a*. The difference compared with the structure shown in FIGS. 4*a* and 4*b* is that in this example the tuning element is connected fixedly to the conductor rod and is moved by shifting the conductor rod vertically. In this case no horizontal control pin fastened to the tuning element, seen in FIG. 4*b*, and slot in the side wall 602 are needed, of course. Because the conductor rod 624 moves, it can now not be connected fixedly to the coupling element 623. The conductor rod is coated by an insulating layer INS, and the rod with its coating runs through a hole in the coupling element making contact to the surface of this hole. The coupling between the conductor rod and tuning element is then capacitive. The insulating layer is so thin that the impedance between the conductor rod and tuning element is very low. For increasing the capacitance and thus lowering the impedance the coupling element may comprise a short metal pipe at its hole, the conductor rod running through the pipe.

The conductor rod 624 has a dielectric extension 624*b* which extends through a hole in the filter's lid 605 above it. The extension is dielectric in order to prevent a significant coupling from the tuning element 625 to the ground through the lid, when the tuning element is in the roomy lower part of the hole HL6. On the upper surface of the lid there is an actuator AC6, to the mechanism of which the extension of the conductor rod connects. In the example of FIG. 6 the actuator is a step motor, a cogwheel on the shaft of which is located in a cog groove formed in the rod 624*b*. When a control pulse is given to the step motor, the cogwheel turns one step, and the control rod and the tuning element fastened to it move vertically a certain short distance.

Figure 7A:
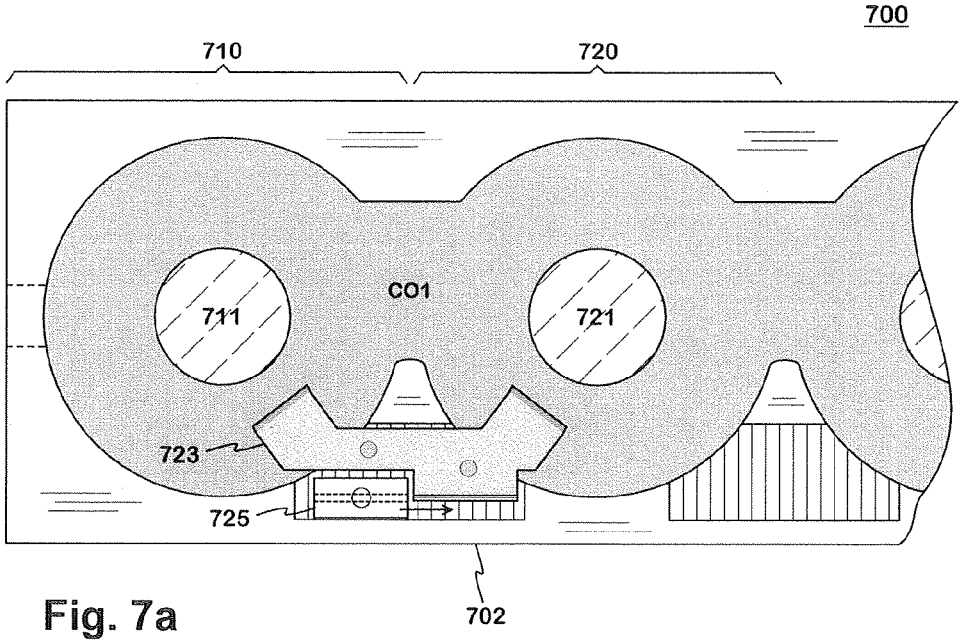
FIGS. 7*a-c* present a fourth example of the adjustable resonator filter according to the invention.
Figure 7B:
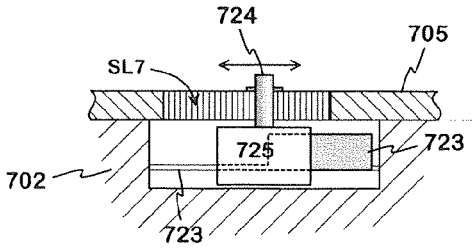
Figure 7C:
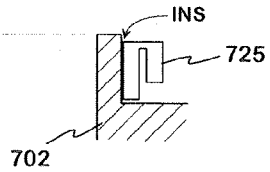

FIGS. 7*a-c* show a fourth example of the adjustable resonator filter according to the invention. In FIG. 7*a*, the filter 700 is presented from above with the lid removed. It comprises a conductive housing, a side wall 702 of which has been marked in the figure. A first resonator 710, a second resonator 720 and a part of a third resonator of the filter 700 are seen. The resonator cavities are in this example cylindrical, and two successive cavities join each other through a coupling opening CO1 which extends here as far as the bottom of the filter housing. In each cavity there is the inner conductor 711; 721 of the resonator joining the bottom, as in FIG. 2.

The drawings present the adjusting arrangement of the coupling between the first and second resonators. In FIG. 7*b* this arrangement is seen as a section figure from the side. The arrangement comprises a fixed conductive coupling element 723 and a movable conductive tuning element 725. The coupling element 723 extends also in this example from the cavity of the first resonator to the cavity of the second resonator through a canal in the upper part of the first side wall 702. The coupling element has been supported above the lower surface of the canal so that it is insulated from the filter housing. In this example the tuning element 725 is moved horizontally in the above-mentioned canal between the resonator cavities. For this purpose the tuning element has been fastened to a vertical control rod 724 which extends through a slot SL7 in the filter's lid 705 above the lid. The tuning element moves together with the control rod, when this is shifted in the slot SL7 for example by means of an actuator. The control rod is preferably dielectric in order to prevent a metallic junction between it and the surface of the slot.

In FIG. 7*c* the tuning element 725 is seen as viewed from its head. The gap between one side surface of the tuning element and the vertical surface of the canal in the wall 702 of the filter housing is so small that the impedance, which corresponds to the capacitance between these surfaces, is very low. To prevent the galvanic contact either one of said surfaces can be coated by an insulating layer INS. The tuning element 725 includes a groove which is directed from its lower surface upwards and extends in the longitudinal direction, or the moving direction of the tuning element, through it. There can also be an insulating layer between the lower surface of the tuning element and the bottom of said canal, which layer at the same time supports the tuning element vertically.

The coupling element 723 comprises a vertical projection, the thickness of which is a little smaller than the width of said groove and the height of which corresponds to the depth of the groove. When the tuning element 725 is at one end of its adjusting range, the vertical projection of the coupling element is in the groove of the tuning element along the whole groove. There is then a significant capacitive coupling from the coupling element 723 to the tuning element and further to the filter housing, or ground. In this situation the effect of the coupling element on the total coupling between the resonators is minor, and the total coupling is at its maximum being based almost wholly on the coupling through the coupling opening CO1. When the tuning element is at the opposite end of its adjusting range it is wholly aside the vertical projection of the coupling element. The capacitance between the tuning element and coupling element is then so low that it is insignificant, and correspondingly the coupling from the coupling element to the ground is so weak that it is insignificant. In this situation the coupling between the resonators implemented by the coupling element 723 partly compensates the coupling which takes place through the coupling opening CO1, in which case the total coupling is at its minimum. When the projection of the coupling element is in a part of the groove in the tuning element, the coupling between the coupling element and ground changes quite linearly as a function of transition of the tuning element.

Also either the vertical projection of the coupling element or the groove of the tuning element can be coated by a thin insulating layer to ensure that no galvanic coupling exists.

Alternatively, the coupling element may comprise, instead of a vertical projection, only a horizontal projection, and the groove in the tuning element is correspondingly inwards from the side surface on the side of the resonator cavities. In this case the capacitance between the lower surface of the tuning element and the wall of the filter housing can be most significant in the coupling between the coupling element and ground. Further, the control rod to which the tuning element is fastened can extend outside the filter housing also through a slot in its wall instead of a slot in the lid.

Figure 8:
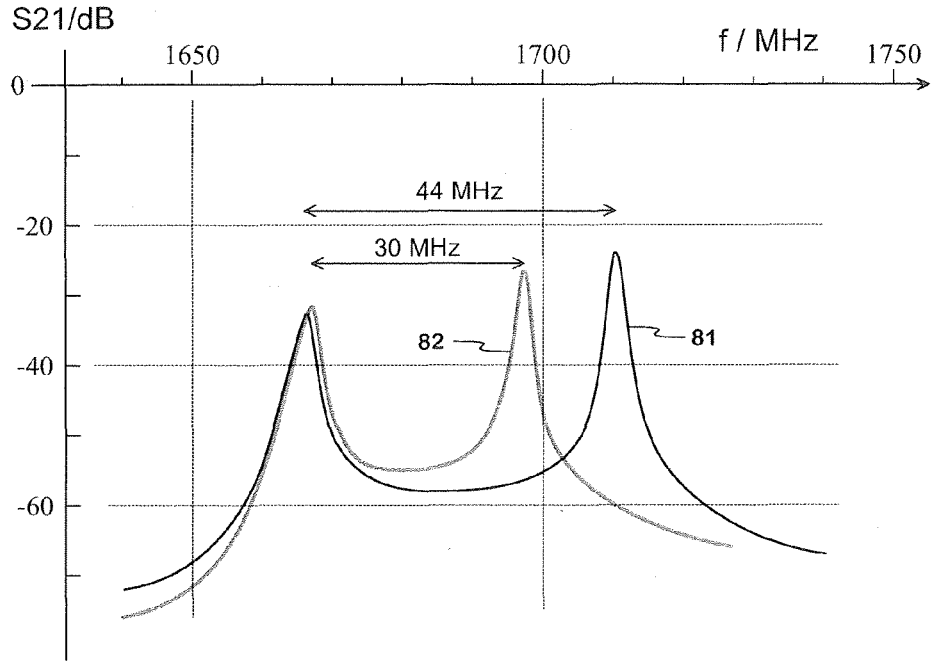
FIG. 8 presents an example of the change in the coupling between the resonators of a filter according to the invention.

FIG. 8 presents an example of the change in the coupling between the resonators of a filter according to the invention. The figure shows the measurement result of one resonator pair in the filter. Curve 81 shows the transmission coefficient S21 of the resonator pair as a function of frequency, when the tuning element in question has been set to a certain point in its adjusting range, and curve 82 shows the transmission coefficient as a function of frequency, when the tuning element has been moved closer to the end of its adjusting range, which corresponds to the minimum coupling. It can be seen that the distance between the peaks of the double resonance is in the former case 44 MHz and in the latter case 30 MHz. When corresponding adjustments are done also by the other tuning elements in the filter, the bandwidth decreases, depending somewhat on the number of the resonators, for example from 50 MHz to 35 MHz.

Figure 9:
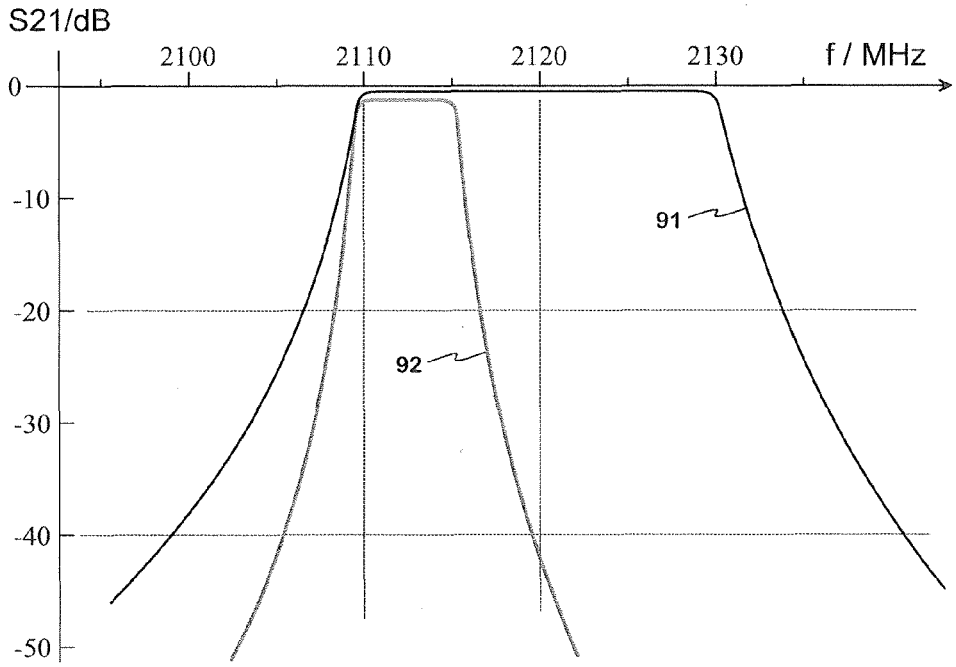
FIG. 9 presents an example of the change in the bandwidth of a filter according to the invention.

FIG. 9 shows an example of the change in the bandwidth of a filter according to the invention. A filter comprised of six coaxial resonators is in question. In the figure there is the transmission coefficient S21 of the whole filter as a function of frequency, i.e. the amplitude response, in two situations. Curve 91 shows the response, when the width of the filter's passband has been set to about 20 MHz, and curve 92 shows the response, when the width of the passband has been set to about 5 MHz. In both cases the passband has been arranged to start from the same frequency by adjusting the natural frequency of the resonators.

The adjustment of the width of the passband according to FIG. 9 succeeds if the mechanical dimensioning is suitable and the coupling strength both between the resonators and in the input and output of the filter is changed in proportion by near the same amount when changing the bandwidth. The values of the coupling coefficient are decreased about in proportion 0.3 when transferring from the case of curve 91 to the case of curve 92.

The qualifiers 'horizontal', 'vertical', 'lower', 'upper', 'downwards', 'upwards' and 'from above' refer in this description and the claims to a position of the filter in which the lid and bottom of the filter housing are horizontal, the lid upper, and these qualifiers have nothing to do with the use position of the filter.

An adjustable resonator filter has been described above. Its tuning mechanism can naturally differ in detail from the ones presented, in respect of e.g. the shape of the structural parts. In the adjustment of the coupling between the resonators the holes in the wall structure of the filter can be shaped also so that their roomier part is upper and the more confined part lower. In this case the downward movement of the tuning elements strengthens the couplings. In addition, the hole can then be worked so that it does not extend through the bottom. The actuators which move the tuning elements can be, besides said step motor, for example devices based on piezoelectricity, which implement a linear movement. The actuators may have a control unit which gives the right electrical control to each actuator on grounds of a common command. The invention does not limit the manufacturing way of the resonators and their tuning elements. The inventive idea can be applied in different ways as appreciated by those skilled in the art.

What is claimed is:

1. An adjustable resonator filter which comprises a filter housing comprising:

a bottom, a plurality of walls and a lid and functioning as a ground of a transmission path, the space of which housing is divided into resonator cavities by conductive partition walls to form a plurality of resonators, and in each partition wall separating two successive cavities on the transmission path there is a coupling opening to excite an oscillation in a latter successive cavity, and the filter comprises a first movable and conductive tuning element for at least two successive resonators to adjust the coupling between these resonators and, thus, a bandwidth of the filter, wherein;

a conductive fixed coupling element extends from at least one resonator cavity of the resonator cavities to a next successive resonator cavity of the resonator cavities through a canal in an upper part of a wall of the plurality of walls of the filter housing;

said first movable and conductive tuning element is located outside the resonator cavities in the wall of the plurality of walls of the filter housing, and an adjustable capacitive coupling exists through the first movable and conductive tuning element from said fixed coupling element to the ground for changing the coupling, implemented by the coupling element, between successive resonators of the plurality of resonators;

said coupling opening between two successive resonators of the plurality of resonators is dimensioned and the corresponding fixed coupling element is positioned so that the coupling between the resonators implemented by this coupling element is arranged to partly compensate the coupling which takes place through the coupling opening;

the filter further comprises a cylindrical second movable and conductive tuning element for adjusting a coupling between an input resonator of the plurality of resonators and an input line of the filter or for adjusting a coupling between an output resonator of the plurality of resonators and an output line of the filter;

wherein the second movable and conductive tuning element is supported to a conductor rod so that it can be slid along the conductor rod, which conductor rod, or middle rod, extends from a middle conductor of a coaxial connector of the filter through an opening in a wall of the plurality of walls of the filter housing to a cavity of the input or output resonator and is connected there to an inner coupling element of the respective input or output resonator;

an outer conductor which connects galvanically to said wall at its one end and to an outer conductor of said connector at its other end, surrounds the middle rod so that the middle rod with the second movable and conductive tuning element and the outer conductor constitute a transmission line belonging to the transmission path of the filter, and a diameter of the middle rod is sufficiently short and a diameter of the cylindrical second movable and conductive tuning element supported to it is sufficiently long that an impedance of said transmission line is at the second movable and conductive tuning element substantially lower and on both sides of the second movable and conductive tuning element substantially higher than the nominal impedance of the transmission path of the filter.

2. An adjustable resonator filter according to claim 1, wherein said first movable and conductive tuning element for adjusting the coupling between resonators is located in a vertical hole inside a wall structure of the filter housing, is supported to a conductor rod running through the first movable and conductive tuning element and is coupled electrically to said coupling element through the conductor rod, and said hole comprises an upper part with an inner surface, only a narrow air gap existing between the inner surface of the upper part and the first movable and conductive tuning element in the upper part to implement a significant capacitive coupling from the coupling element to the ground, and a roomier lower part having an inner surface, wherein a capacitance between the inner surface of the lower part of the hole and the first movable and conductive tuning element in the lower part of the hole being so low that it is insignificant.

3. An adjustable resonator filter according to claim 2, wherein said first movable and conductive tuning element is insulated from the conductor rod and can be slid along the conductor rod, which rod is vertical and connected at an upper end thereof fixedly to said coupling element.

4. An adjustable resonator filter according to claim 2, wherein said first movable and conductive tuning element is fastened to the conductor rod, which rod is vertically movable and runs as insulated through said coupling element, being thus capacitively coupled to the coupling element.

5. An adjustable resonator filter according to claim 1, wherein said first movable and conductive tuning element for adjusting the coupling between resonators is located in a canal inside a wall of the filter housing, through which canal said coupling element extends from one resonator cavity to another, and the first movable and conductive tuning element is horizontally movable by a control rod to which it is fastened and which rod extends through a slot in the filter housing outside the housing, a capacitive coupling corresponding to a low impedance exists between the first movable and conductive tuning element and the surface of said canal, in the first movable and conductive tuning element there is a groove which extends through this element in its moving direction and the coupling element comprises a corresponding projection which is in the groove of the first movable and conductive tuning element along the whole groove when the first movable and conductive tuning element is at one end of its adjusting range to implement a capacitive coupling from the coupling element to the first movable and conductive tuning element and further to the ground, and when the first movable and conductive tuning element is at the other end of its adjusting range it is wholly aside the projection of the coupling element to make the coupling between the coupling element and ground weak.

6. An adjustable resonator filter according to claim 1, wherein said transmission line in the input and output of the filter is dimensioned so that a movement of the second movable and conductive tuning element, which comprises part of the transmission line, along the middle rod towards the input/output resonator is arranged to cause a strengthening of the coupling from the resonator in question to a line to be connected to the filter.

7. An adjustable resonator filter according to claim 3, wherein an actuator is fastened to an outer surface of the filter housing for said first movable and conductive tuning element to move the first movable and conductive tuning element, and a dielectric control pin is fastened to the first movable and conductive tuning element, which pin extends through a slot in the wall of the filter to the actuator.

8. An adjustable resonator filter according to claim 4, wherein an actuator is fastened on the lid of the filter housing for said first movable and conductive tuning element to move the first movable and conductive tuning element, and said conductor rod has a dielectric extension which extends through a hole in the lid of the filter to the actuator.

9. An adjustable resonator filter according to claim 6, wherein an actuator is fastened to an outer surface of said outer conductor to move the second movable and conductive tuning element, and a dielectric control pin is fastened to the second movable and conductive tuning element, which pin extends through a slot in the outer conductor to the actuator.

10. An adjustable resonator filter according to claim 1, wherein said resonators are coaxial quarter-wave resonators, each of which includes an inner conductor which joins at its lower end galvanically the bottom of the filter housing.

11. An adjustable resonator filter according to claim 1, wherein said resonators are dielectric cavity resonators, and a dielectric resonator object is configured in each resonator cavity, which is supported to the bottom of the filter housing.

* * * * *